US011434057B1

(12) United States Patent
Benes

(10) Patent No.: US 11,434,057 B1
(45) Date of Patent: Sep. 6, 2022

(54) PAWL ASSEMBLY FOR A CAN CARRIER APPLICATOR APPARATUS

(71) Applicant: David J. Benes, Elkhorn, NE (US)

(72) Inventor: David J. Benes, Elkhorn, NE (US)

( * ) Notice: Subject to any disclaimer, the term of this patent is extended or adjusted under 35 U.S.C. 154(b) by 88 days.

(21) Appl. No.: 16/874,809

(22) Filed: May 15, 2020

Related U.S. Application Data

(63) Continuation-in-part of application No. 16/868,810, filed on May 7, 2020.

(51) Int. Cl.
*B65D 25/20* (2006.01)
*B65D 71/50* (2006.01)

(52) U.S. Cl.
CPC ..... *B65D 71/50* (2013.01); *B65D 25/20* (2013.01); *B65D 2581/055* (2013.01)

(58) Field of Classification Search
USPC ..... 53/48.1, 398, 81, 471, 168, 158
See application file for complete search history.

(56) References Cited

U.S. PATENT DOCUMENTS 3,549,459 A * 12/1970 Whitecar ..... B65B 61/202 156/568
5,088,269 A * 2/1992 Thelen ..... B65B 17/025 53/398
5,233,811 A * 8/1993 Odum ..... B65B 17/025 53/48.4
5,287,677 A * 2/1994 Hunter ..... B65B 17/025 53/398
7,377,382 B2 5/2008 Borg et al.
7,588,275 B2 9/2009 Borg
10,457,430 B2 10/2019 Daniel et al.

OTHER PUBLICATIONS

PakTech Can Carrier Applicator CCA280 https://www.youtube.com/watch?v=2EqYFC8ZCag&list=PLFU_eb5_QGpj6S7SPeosOjK7EgUJQWhXR&index=2 accessed Dec. 4, 2021; Jan. 27, 2016 (Year: 2016).*
PakTech Can Carrier Applicator CCA120 https://www.youtube.com/watch?v=GFxsQghsqv8&list=PLFU_eb5_QGpj6S7SPeosOjK7EgUJQWhXR&index=1 accessed Dec. 4, 2021 Jan. 27, 2016 (Year: 2016).*

* cited by examiner

*Primary Examiner* — Chinyere J Rushing-Tucker
(74) *Attorney, Agent, or Firm* — Suiter Swantz pc llo

(57) ABSTRACT

A pivotal pawl assembly for a can carrier applicator apparatus is disclosed. The apparatus includes spaced-apart and vertically disposed first and second support walls. The first and second support walls define a can passageway having a forward end and a rearward end. A vertically disposed spacer is vertically movably positioned at the forward end of the support walls with the lower end of the spacer being positioned above the lower ends of the support walls. The pawl assembly is positioned at the lower rearward end of the spacer. A plurality of stacked can carriers are positioned above the can passageway. A dispensing mechanism sequentially dispenses a can carrier which drops downwardly onto the cans. The pawl assembly not only limits the forward movement of the can carrier but also exerts downward force on the can carrier to seat the can carrier onto the cans moving through the can passageway.

6 Claims, 13 Drawing Sheets

PAWL ASSEMBLY FOR A CAN CARRIER APPLICATOR APPARATUS

CROSS REFERENCE TO RELATED APPLICATION

This is a Continuation-In-Part Application of application Ser. No. 16/868,810 filed May 7, 2020, entitled CAN GUIDE SYSTEM FOR A CAN CARRIER APPLICATOR APPARATUS.

Your Petitioner, DAVID J. BENES, a citizen of the United States and a resident of the State of Nebraska, whose post office address is 22011 Stanford Circle, Ekhorn, Nebr. 68022, pray(s) that Letters Patent may be granted to him for the invention set forth in the following specification.

BACKGROUND OF THE INVENTION

Field of the Invention

This invention relates to a pawl assembly for use in a can carrier applicator machine.

Description of the Related Art

Can carriers such as described in U.S. Pat. No. 7,588,275 are applied to cans to provide a convenient way for a person to carry either two cans, four cans or six cans by the handles thereof. The plastic can carriers are applied to the upper ends of the cans as the cans are moved through the prior art can carrier applicator machines. It is believed that the prior art can carrier applicator machines have difficulty in properly positioning the can carriers with respect to the cans passing therethrough. It is also believed that prior art can carrier applicator machines have difficulty in placing the can carriers onto the cans passing therethrough.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A pivotal pawl assembly is described for use in a can carrier applicator apparatus or machine. The can carrier applicator apparatus or machine is designed to apply can carriers onto the upper ends of a plurality of cans as the cans pass through the apparatus. The apparatus includes a can passageway which is defined by horizontally spaced-apart and vertically disposed first and second support walls with the can passageway having a forward end, a rearward end, a lower end and an upper end. Each of the first and second support walls have a forward end, a rearward end, an upper end, a lower end, an inner side and an outer side. The apparatus also has a can carrier hopper at the upper end of the can passageway with the can carrier hopper being configured to support a plurality of can carriers, having forward and rearward ends, in a stacked position one on top of the other. The can carrier hopper and associated structure are configured to position the lowermost can carrier therein above the cans onto which the can carrier is to be applied. The apparatus also includes a vertically disposed standoff having a first end, a second end, an upper end, a lower end, a rear side and a front side. The first end of the standoff is fixed to the first support wall at the upper end thereof and at the forward end thereof. The second end of the standoff is fixed to the second support wall at the upper end thereof and at the forward end thereof.

The apparatus also includes a vertically disposed front spacer having a first end, a second end, an upper end, a lower end, a front side and a rear side. The front spacer is positioned at the rear side of the standoff. The front spacer has an opening formed therein which extends between the front and rear sides thereof. The first end of the front spacer is vertically movably secured to the first support wall at the upper end thereof. The second end of the front spacer is vertically movably secured to the second support wall at the upper end thereof. The front spacer is vertically movable between upper and lower positions with respect to the first and second support walls. The front spacer has a plurality of vertically disposed and horizontally spaced-apart spring openings formed therein which extend partially downwardly thereinto from the upper end thereof. An elongated compression spring, having upper and lower ends, has the lower end thereof positioned in each of the spring openings. The upper ends of the compression springs are positioned above the upper end of the front spacer. A spring retainer is mounted on the upper end of the standoff which is positioned over the upper ends of the compression springs to compress the same and to yieldably urge the front spacer to its lower position.

An elongated and horizontally disposed support tube, having a rear end and a front end, is mounted in the opening in the front spacer whereby the rear end of the support tube is positioned forwardly of the front spacer. A vertically disposed pivotal pawl is pivotally secured about a horizontal axis to the front end of the support tube. The pawl is pivotally movable between a first position and a second position. An elongated coil spring, having a rear end and a front end, is provided with the front end thereof being secured to the support tube. The rear end of the coil spring is secured to the pawl. The coil spring yieldably maintains the pawl in the first position and yieldably resists the pivotal movement of the pawl from the first position to the second position.

The pawl is in the path of a can carrier moving through the apparatus to prevent forward movement of the can carrier until sufficient forward force is applied to the cans upon which the can carrier is being applied. The pawl remains in pivotal contact with the can carrier being applied to the cans moving forwardly therebelow to urge the can carrier downwardly onto the cans due to the coil spring.

It is therefore a principal object to provide an improved pawl assembly for securing can carriers to a plurality of cans passing through a can carrier applicator machine or apparatus.

A further object of the invention is to provide a pawl assembly which prevents the carrier being installed on a plurality of cans from moving too far forwardly.

A further object of the invention is to provide a pawl assembly of the type described which assists in the application of a can carrier to a plurality of cans.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
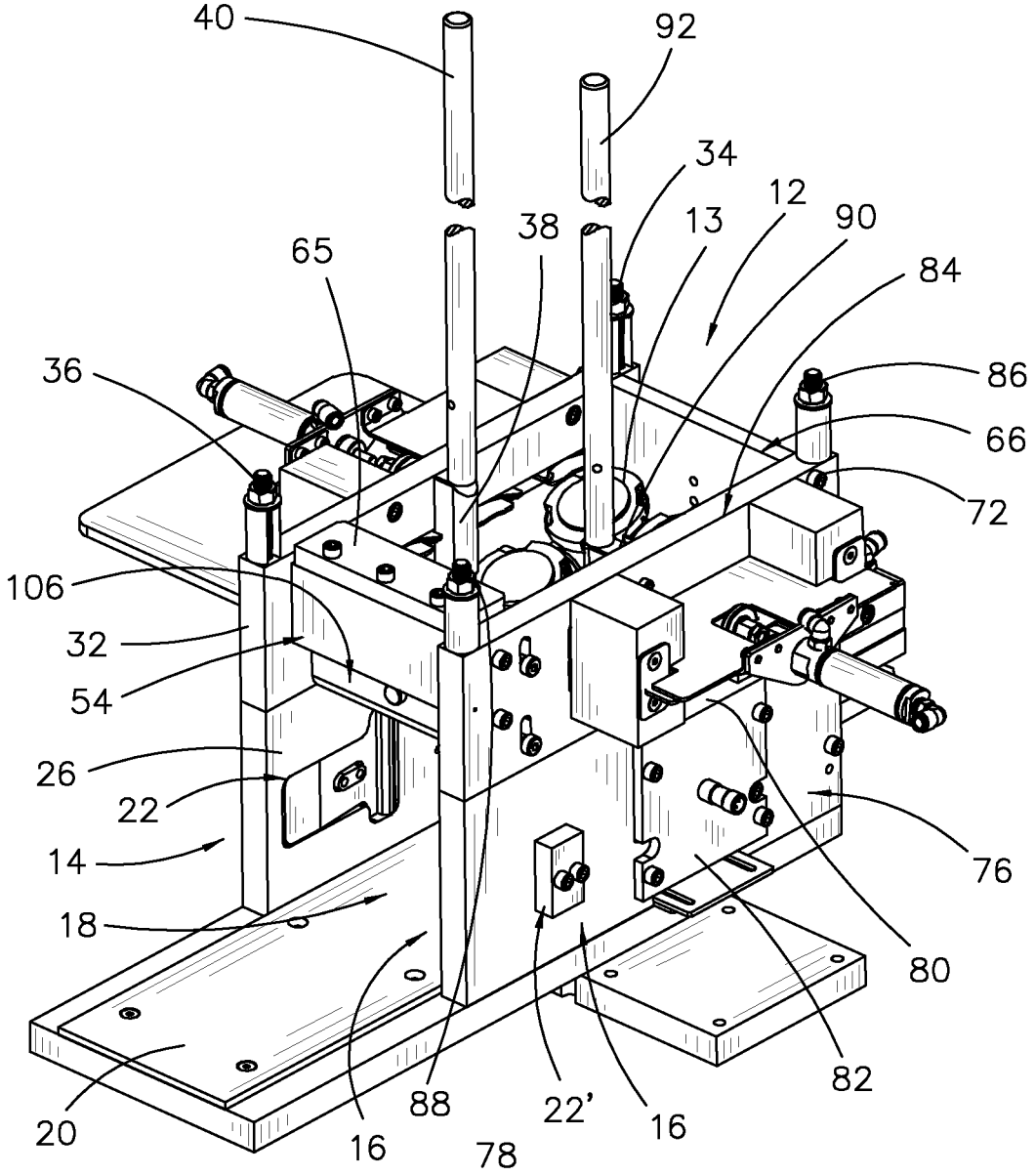
FIG. 1 front is a perspective view of the can carrier applicator machine having the pawl assembly of this invention associated therewith as seen from the left side of the machine.
Figure 2:
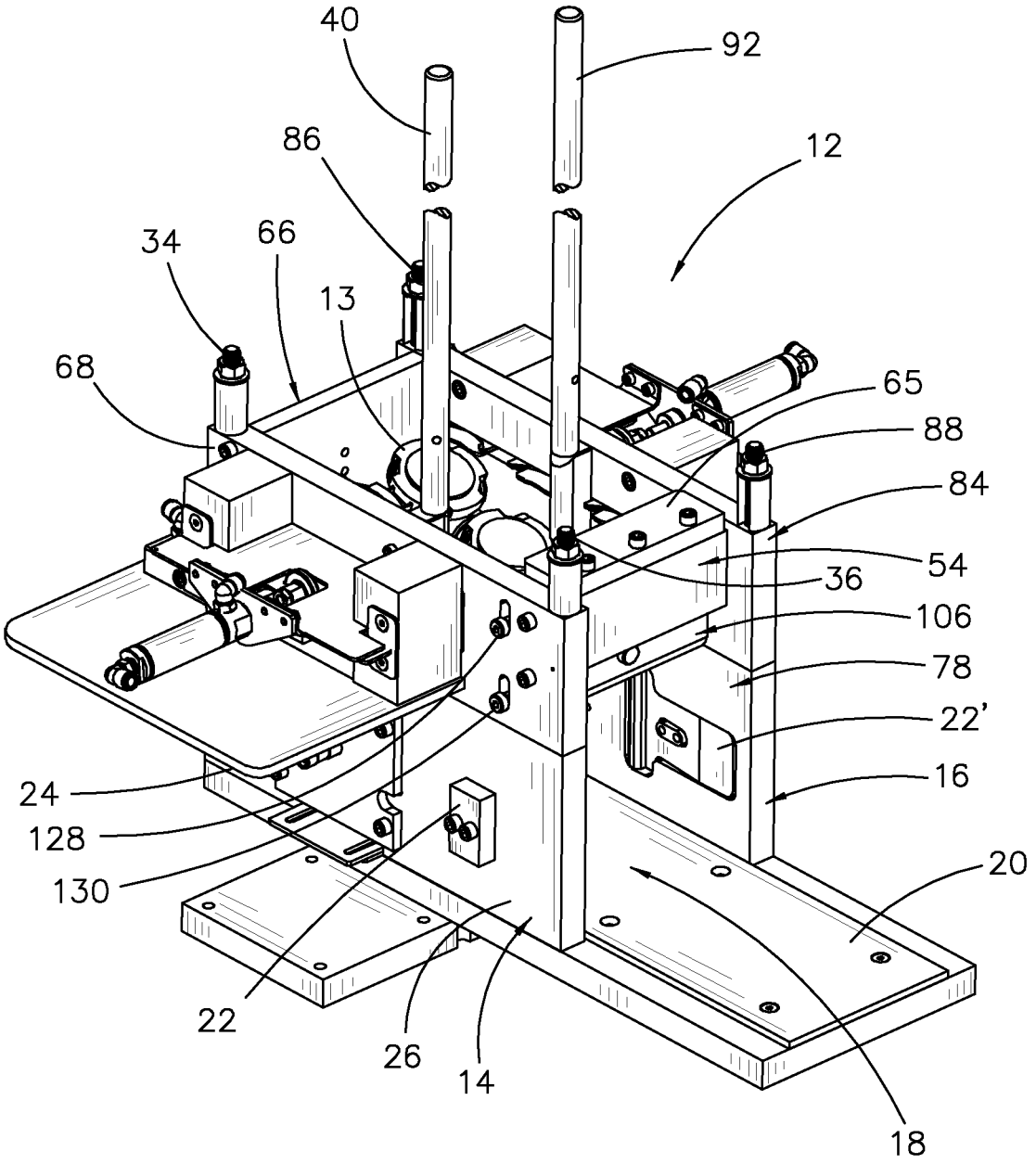
FIG. 2 is a front perspective view of the can carrier applicator machine having the pawl assembly of this invention associated therewith as seen from the right side of the machine.
Figure 3:
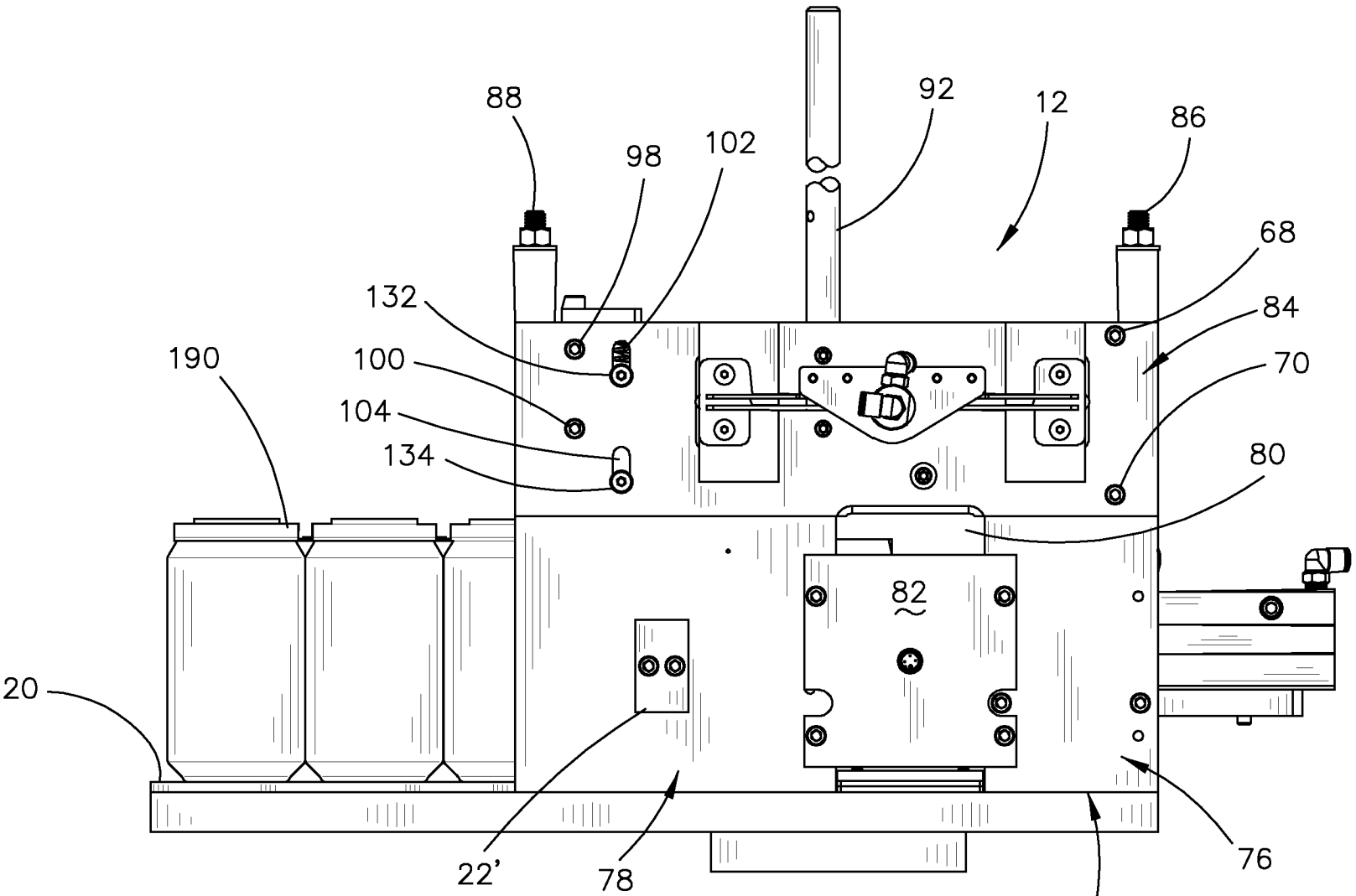
FIG. 3 is a left side view of the can carrier applicator machine having the pawl assembly of this invention associated therewith.
Figure 4:
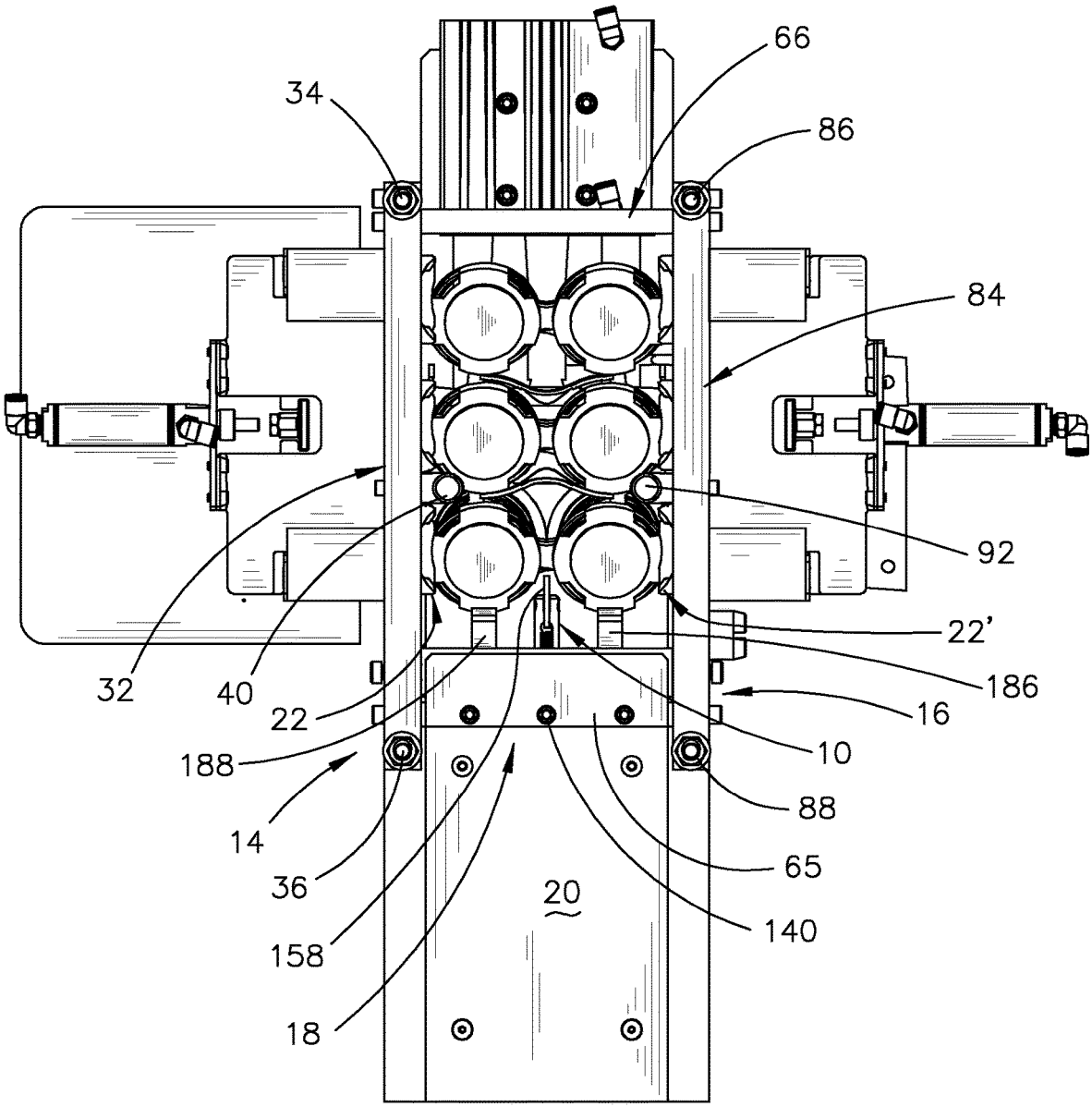
FIG. 4 is a top view of the can carrier machine having the pawl assembly of this invention associated therewith.
Figure 4A:
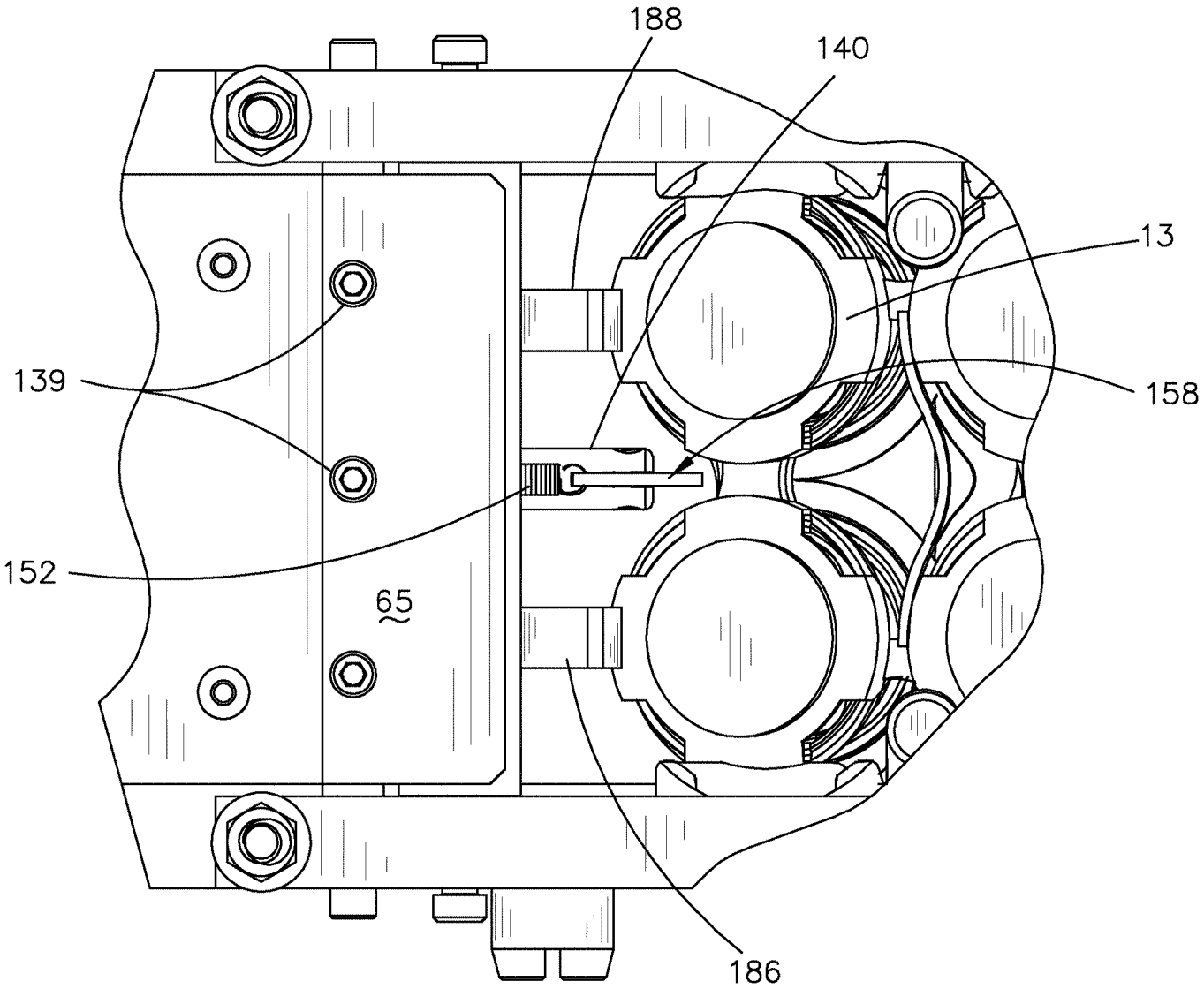
FIG. 4A is a partial top view of the can carrier applicator machine having a pawl assembly of this invention associated therewith.
Figure 5:
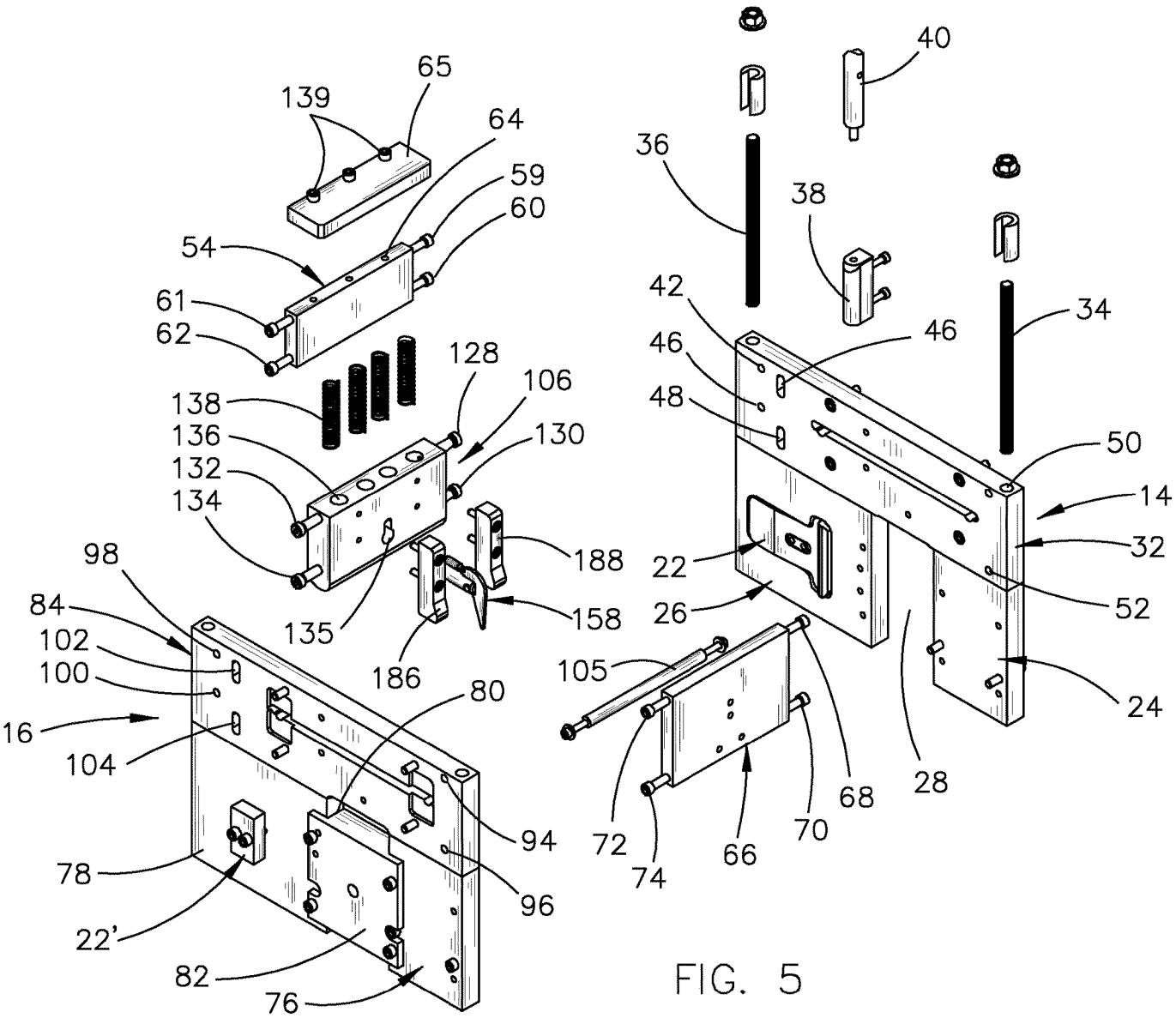
FIG. 5 is a partial exploded perspective view of can carrier applicator machine and the pawl assembly of this invention as seen from the left front end of the can carrier applicator machine.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The pawl assembly of this invention is referred to by the reference numeral 10. Pawl assembly 10 is designed to be used with a can carrier applicator apparatus or machine 12 such as manufactured by Fremont Automation, Inc. of Blair, Nebr. The machine 12 is designed to apply plastic can carriers 13 onto the tops of cans which may be 2 cans, 4 cans or 6 cans. The machine 12 is described in the co-pending application. The disclosure of the co-pending application is incorporated herein by reference thereto to complete this disclosure if necessary. Machine 12 includes a first vertically disposed first support wall assembly 14 and a second vertically disposed support wall assembly 16. The support wall assemblies 14 and 16 define a can passageway 18 therebetween and having a forward can outlet 20.

The machine 12 includes a can guide assembly 22 at the inner side of support wall assembly 14 as described in the co-pending application. Machine 12 also includes a can guide assembly 22' at the inner side of support wall assembly 16 as described in the co-pending application. The can guide assemblies 22 and 22' will not be described in detail other than to state that they have can stops at the forward ends thereof.

The first support wall assembly 14 includes a rear riser 24 and a front riser 26. The front end of rear riser 24 is spaced from the rear end of front riser 26 to provide a can inlet opening 28 therebetween if the cans are fed to the right side of the machine 12. If the cans are not fed to the right side of the machine 12, a plate or block 30 is secured to the outer sides of risers 24 and 26 to lose the can inlet opening 28.

Figure 7:
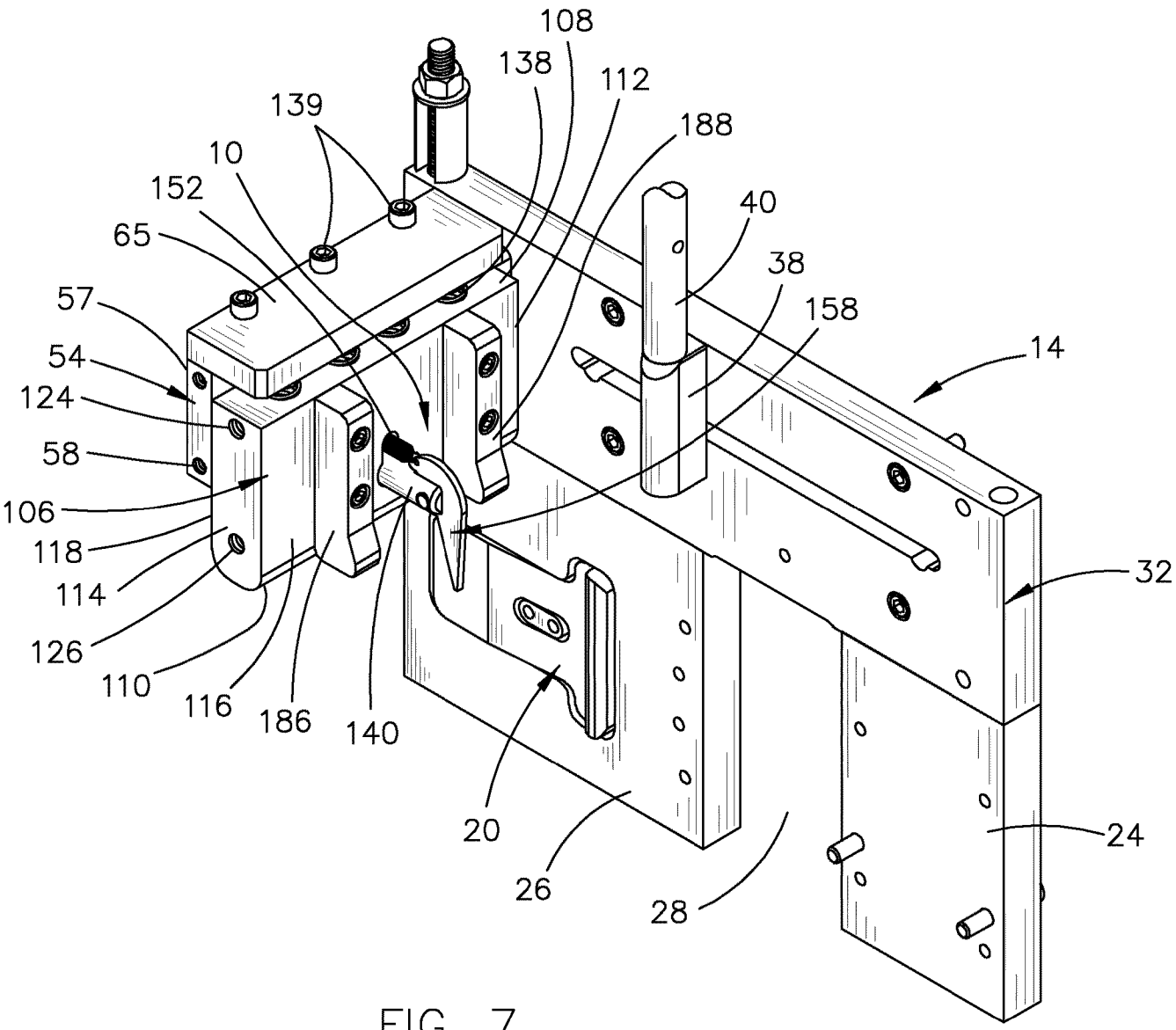
FIG. 7 is a perspective view of the pawl assembly of this invention mounted on the forward end of the right-hand mount of the can carrier applicator machine.
Figure 8:
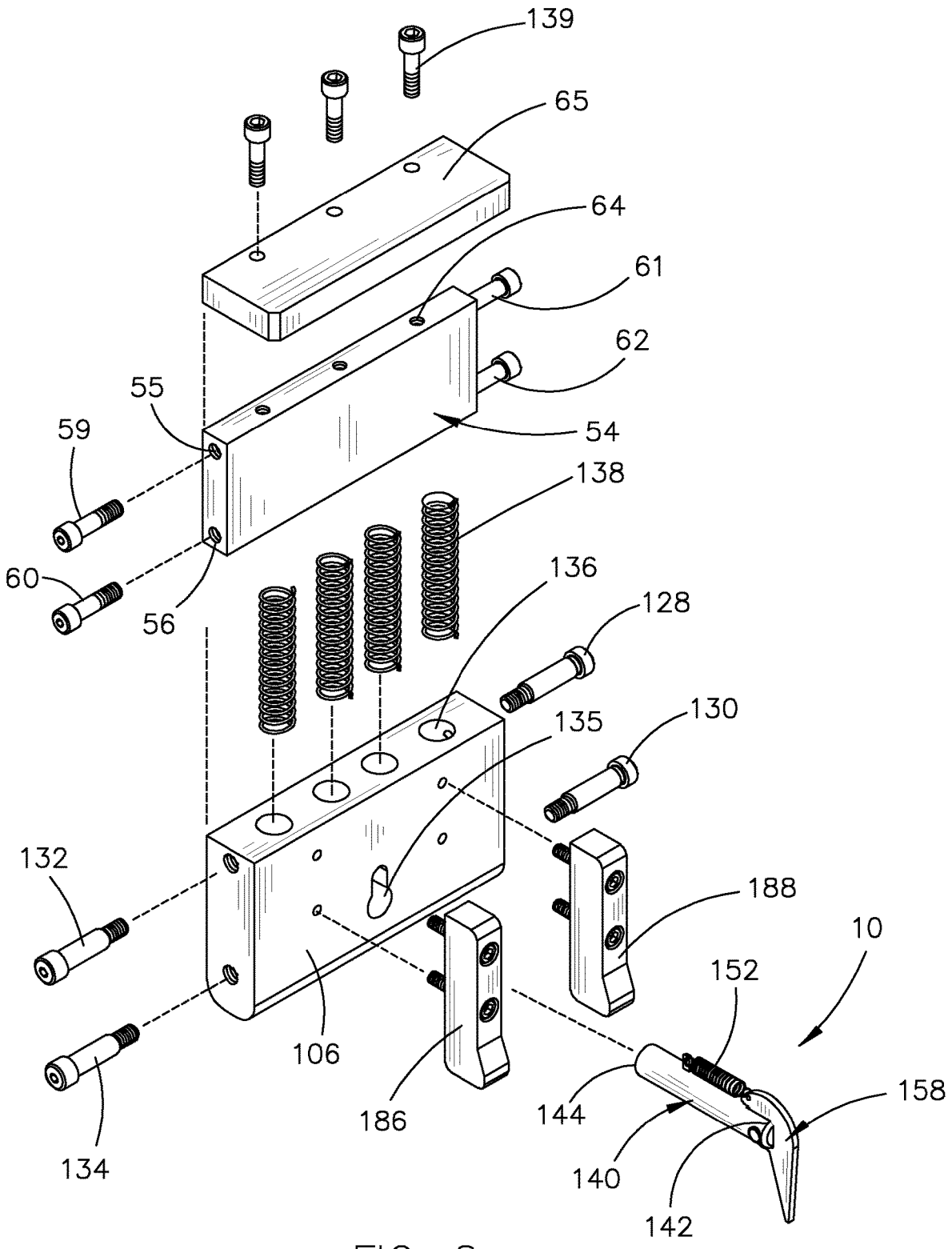
FIG. 8 is a partial exploded perspective view illustrating the pawl assembly of this invention.
Figure 9:
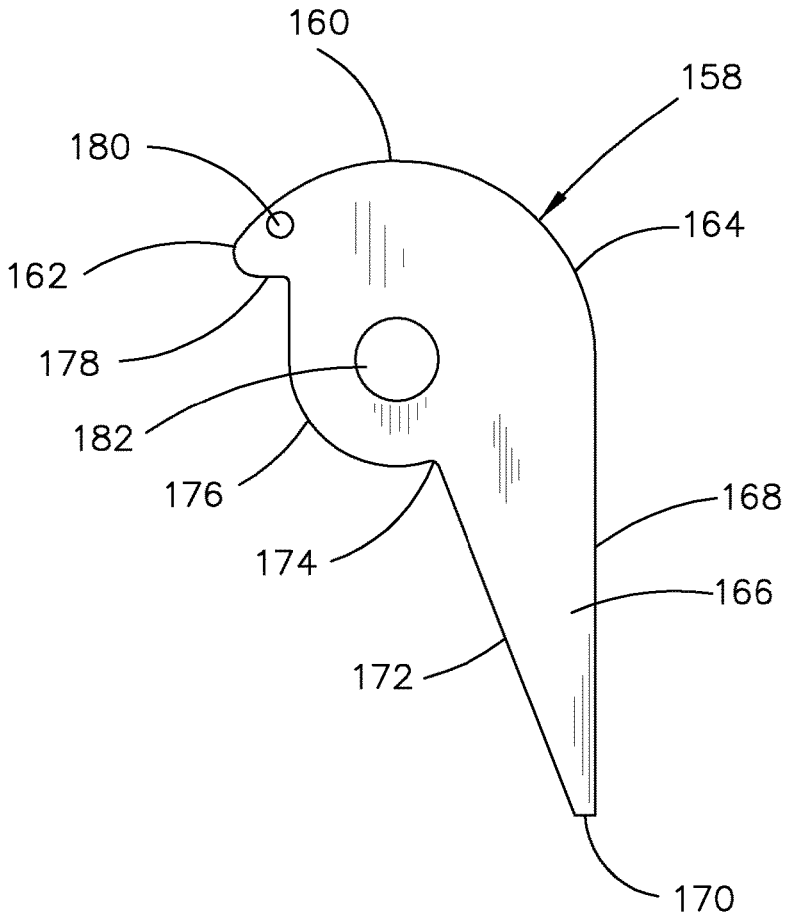
FIG. 9 is a side view of the pawl of this invention.
Figure 9A:
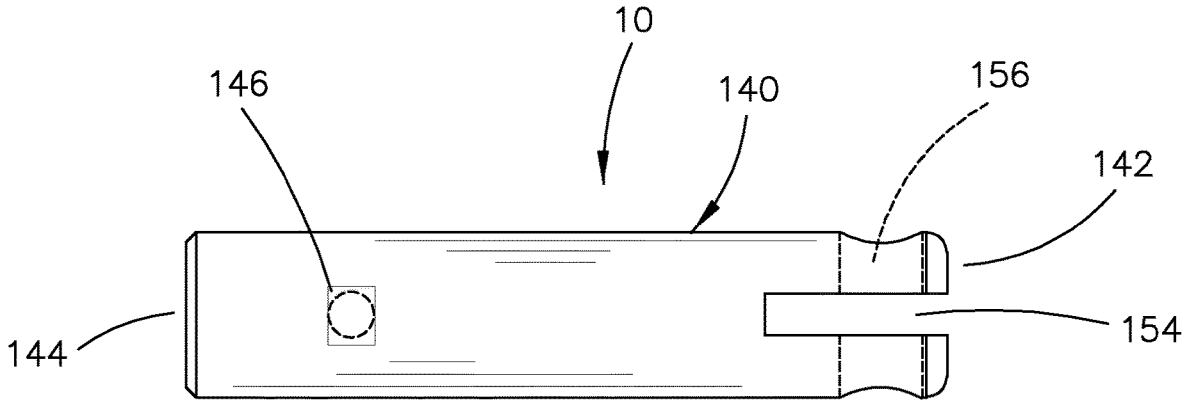
FIG. 9A is a top view of the pawl support tube of this invention.
Figure 10:
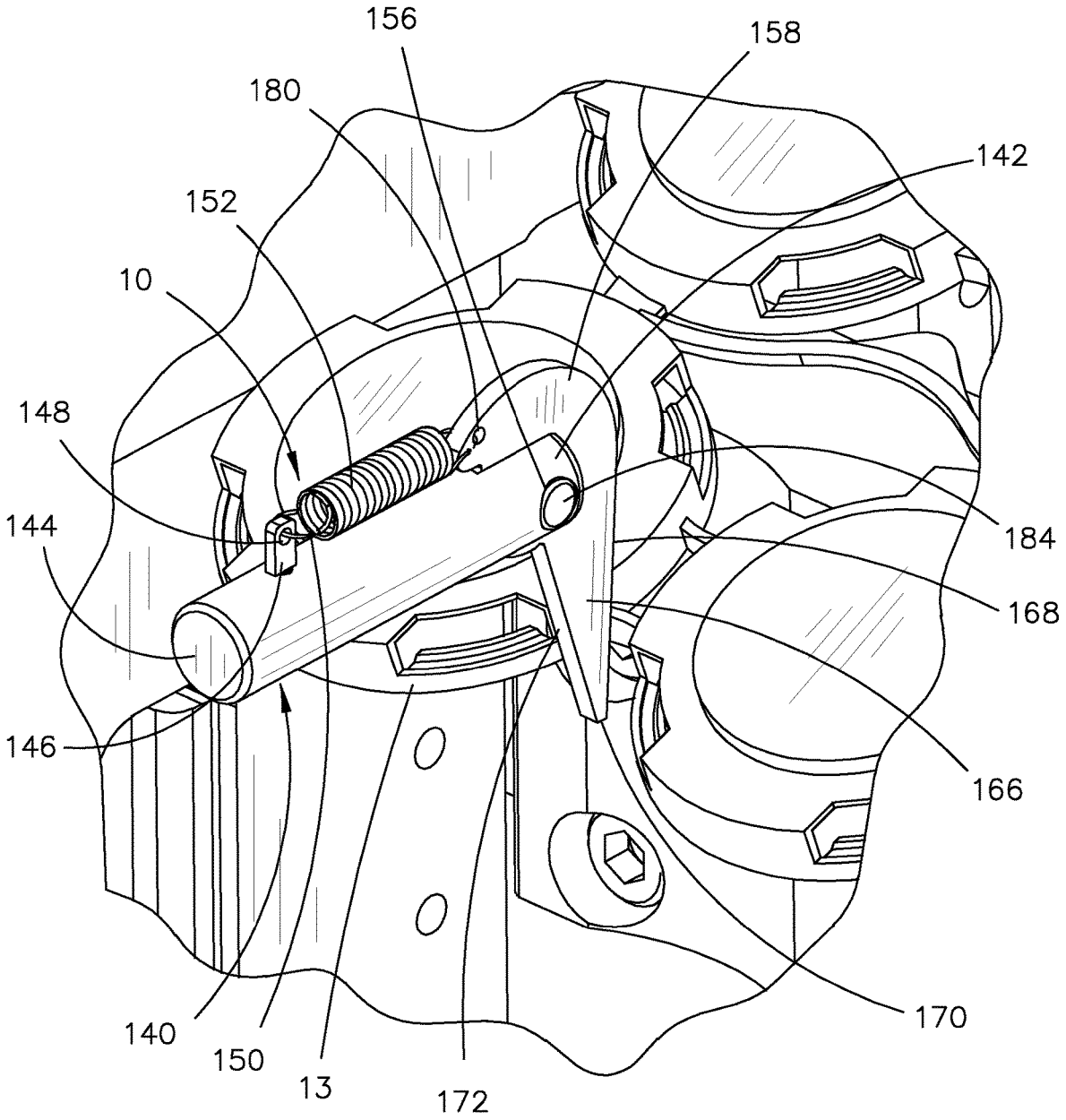
FIG. 10 is a partial perspective view illustrating the pawl of this invention engaging one end of a can carrier.

The first support wall assembly 14 also includes a right-hand mount 32 which is positioned on the upper ends of risers 24 and 26. Threaded rods 34 and 36 secure the mount 32 to the risers 24 and 26. As seen in FIG. 7, a rail mount 38 is positioned at the inner side of mount 32 and is secured thereto. Rail mount 38 has the lower end of a vertically disposed guide rod 40 received therein.

Mount 32 has a pair of vertically spaced openings 42 and 44 formed therein at the front end thereof. Mount 32 also has a pair of vertically disposed slots 46 and 48 formed therein rearwardly of openings 42 and 44. Mount 32 also has a pair of vertically spaced openings 50 and 52 formed therein at the rearward end of mount 32.

The numeral 54 refers to a vertically disposed standoff having a pair of vertically spaced and internally threaded bolt openings 55 and 56 formed in one end thereof and a pair of vertically disposed and internally threaded bolt openings 57 and 58 formed in the other end thereof. Bolts 59 and 60 extend inwardly through openings 42 and 44 in mount 32 and into bolt openings 55 and 56 respectively. Bolts 61 and 62 are received in bolt openings 57 and 58 as will be described hereinafter. Standoff 54 also has a plurality of threaded bores 64 extending downwardly into the upper end thereof. A spring retainer plate 65 is secured to the upper end of standoff 54 so as to extend outwardly therefrom as will be described in more detail hereinafter.

The numeral 66 refers to a vertically disposed rear spacer having a pair of vertically spaced and internally threaded bolt openings formed in one end thereof and a pair of vertically spaced and internally threaded bolt openings formed in the other end thereof. Bolts 68 and 70 extend inwardly through openings 50 and 52 in mount 32 and into the bolt openings in one end of spacer 66 respectively. Bolts 72 and 74 are received in the bolt openings at the other end of spacer 66 as will be described hereinafter.

The second support wall assembly 16 includes a rear riser 76 and a front riser 78. The front end of rear riser 76 is spaced from the rear end of front riser 78 to provide a can inlet opening 80 if the cans are fed to the left side of the machine 12. If the cans are not fed to the left side of the machine 12, a plate or block 82 is secured to the outer sides of risers 76 and 78 to close the can inlet opening 80.

Figure 6:
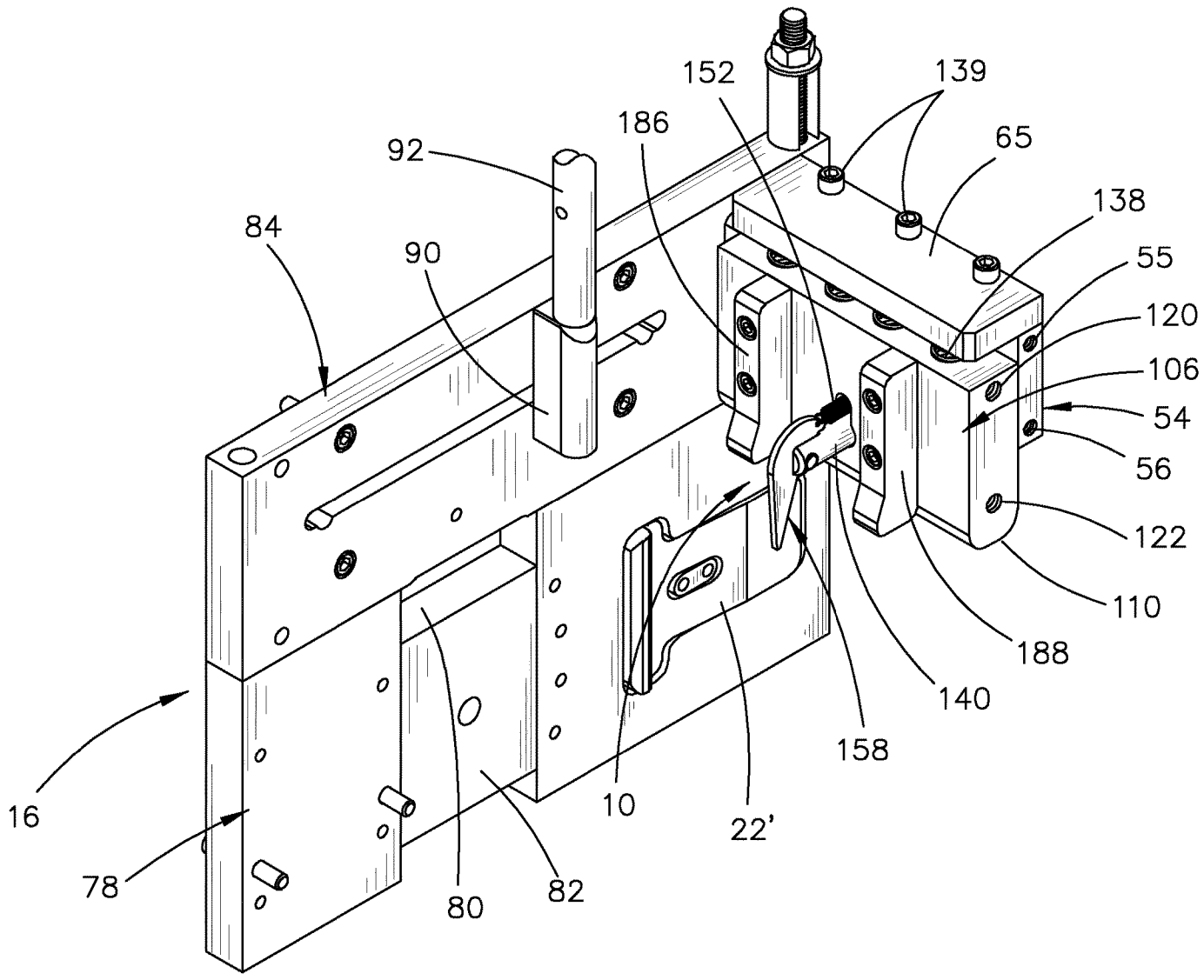
FIG. 6 is a perspective view of the pawl assembly of this invention mounted on the forward end of the left-hand mount of the can carrier applicator machine.

Support wall assembly 16 also includes a left-hand mount 84 which is positioned on the upper ends of risers 76 and 78. Threaded rods 86 and 88 secure the mount 84 to the risers 76 and 78. As seen in FIG. 6, a rail mount 90 is positioned at the inner side of mount 84 and is secured thereto. Rail mount 90 has the lower end of a vertically disposed guide rod 92 received therein.

Mount 84 has a pair of vertically spaced openings 94 and 96 formed therein at the rearward end thereof. Mount 84 also has a pair of vertically spaced openings 98 and 100 formed therein at the forward end thereof. Mount 84 also has a pair of vertically spaced slots 102 and 104 formed therein rearwardly of openings 98 and 100. A bar 105 is secured to mounts 32 and 84 and extends therebetween forwardly of the rear ends of the walls 14 and 16.

The numeral 108 refers to a vertically disposed front spacer having an upper end 108, a lower end 110, a first end 112, a second end 114, a rear side 116 and a front side 118. Spacer 108 has a pair of vertically spaced-apart and internally threaded openings 120 and 122 formed therein which extend inwardly into end 112 thereof. Spacer 108 also has a pair of vertically spaced-apart and internally threaded openings 124 and 126 formed therein which extend inwardly into end 114 thereof.

Bolts 128 and 130 extend inwardly through slots 46 and 48 in mount 32 and into the threaded openings 120 and 122 of spacer 108 respectively. Bob 132 and 134 extend inwardly through slots 102 and 104 in mount 84 and into openings 124 and 126 in spacer 108 so that spacer 106 may move upwardly and downwardly with respect to wall assemblies 14 and 16. The upper end of spacer 106 has a plurality of spring openings 136 formed therein which partially extend downwardly into spacer 106. A plurality of elongated coil springs 138 have their lower ends received in the spring openings 136. The spring retainer plate 65 is secured to the upper end of standoff 54 by bolts 139 with the plate 65 engaging the upper ends of the springs 138 to compress the same whereby the spacer 106 is yieldably urged to a downward position with respect to the wall assemblies 14 and 16.

The pawl assembly 10 will now be described. Pawl assembly 10 includes an elongated cylindrical member or support tube 140 having a rear end 142 and a front end 144. A bracket 146 is secured to support tube 140 rearwardly of the front end 144 and which has an opening 148 formed therein. The front end 150 of coil spring 152 is secured to bracket 146. The rear end 142 of tube 140 has a vertically disposed slot 154 formed therein. The rear end 142 of tube 140 also has a horizontally disposed bore 156 formed therein. Pawl assembly 10 further includes a pivotal pawl 158 which is flat shaped so as to fit into the slot 154 of support tube 140. Pawl 158 includes a curved upper end portion 160 having a front end 162 and a rear end 164. Pawl 158 includes a somewhat V-shaped lower arm 166 having a substantially vertical disposed rear side 168 having a lower end 170 and an upwardly and forwardly extending front side 172 having an upper end 174. Pawl 158 further includes a curved portion 176 which extends upwardly and forwardly from the upper end 174 of front side 172. The upper forward end of curved portion 176 terminates at a horizontally disposed shoulder or stop portion 178. Pawl 158 has a small opening 180 formed therein. Pawl 158 also includes a larger opening 182 formed therein. Pawl 158 is mounted on support tube 140 by positioning pawl 158 within slot 154 of support tube 140 so that opening 182 of pawl 158 is aligned with opening 156 of support tube 158. A pivot pin 184 is then inserted in the openings 158 and 182. In the normal position, the shoulder 178 rests upon the upper side of support tube 140 forwardly of the slot 154. The rear end of spring 152 is secured to the opening 180 of pawl 158 to yieldably maintain the pawl in the first position whereby shoulder 178 maintains contact with support tube 140. Support tube 140 extends forwardly through opening 135 in spacer 108 wherein it is press-fitted.

A pair of can carrier stabilizers 186 and 188 are secured to the rear side of spacer 106 on opposite skies of pawl 158.

Figure 11:
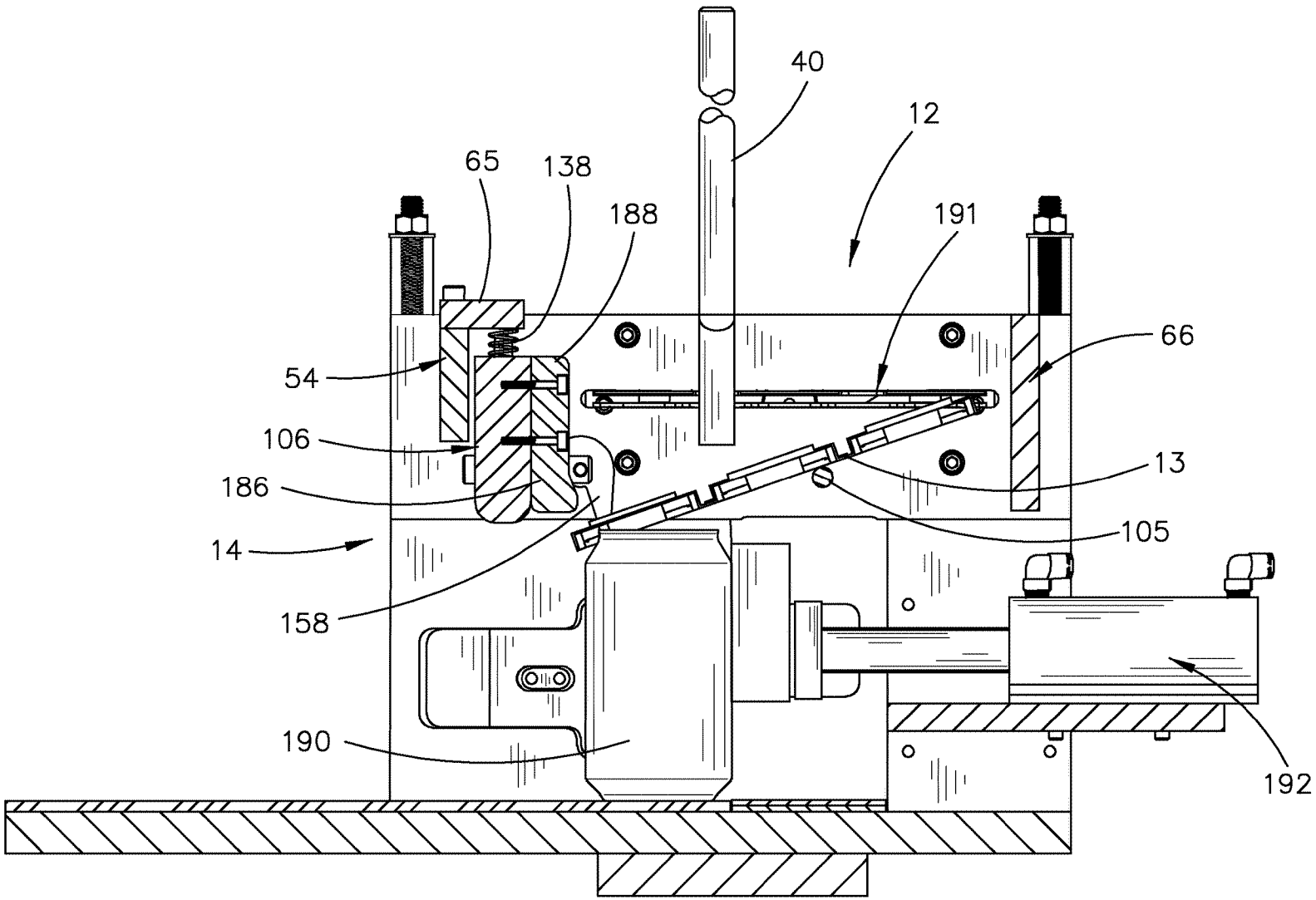
FIG. 11 is a partial sectional view illustrating the pawl of this invention engaging one end of a can carrier which is being applied to cans.
Figure 12:
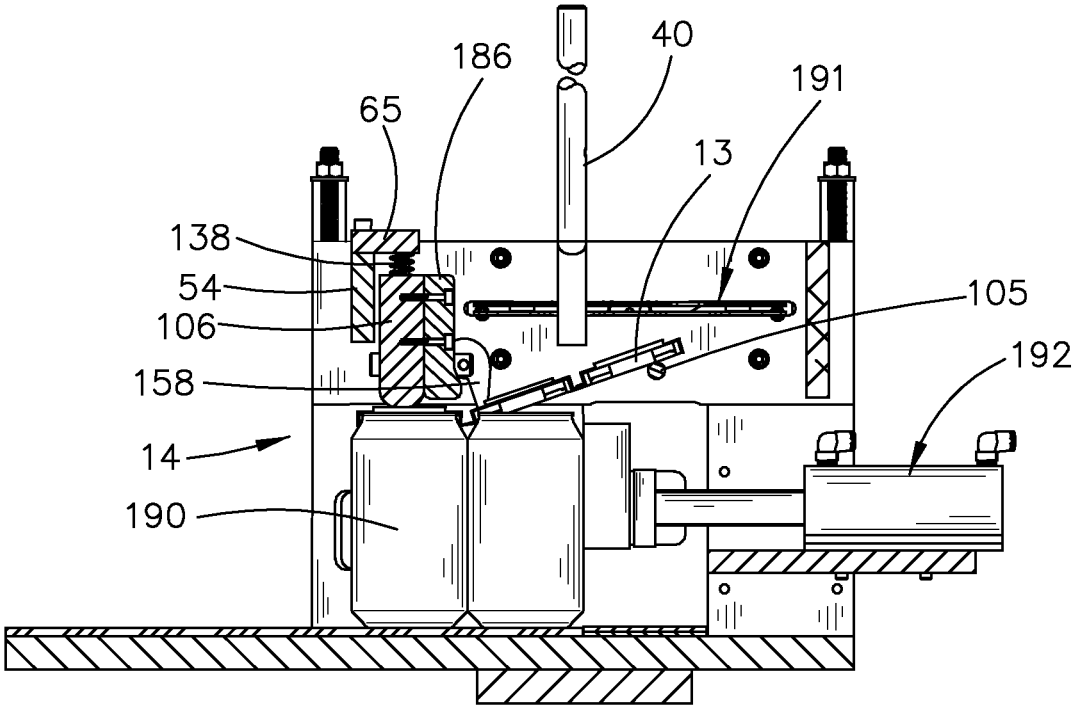
FIG. 12 is a partial sectional view illustrating the pawl of this invention engaging the can carrier of FIG. 10 about to be further applied to trailing cans.
Figure 13:
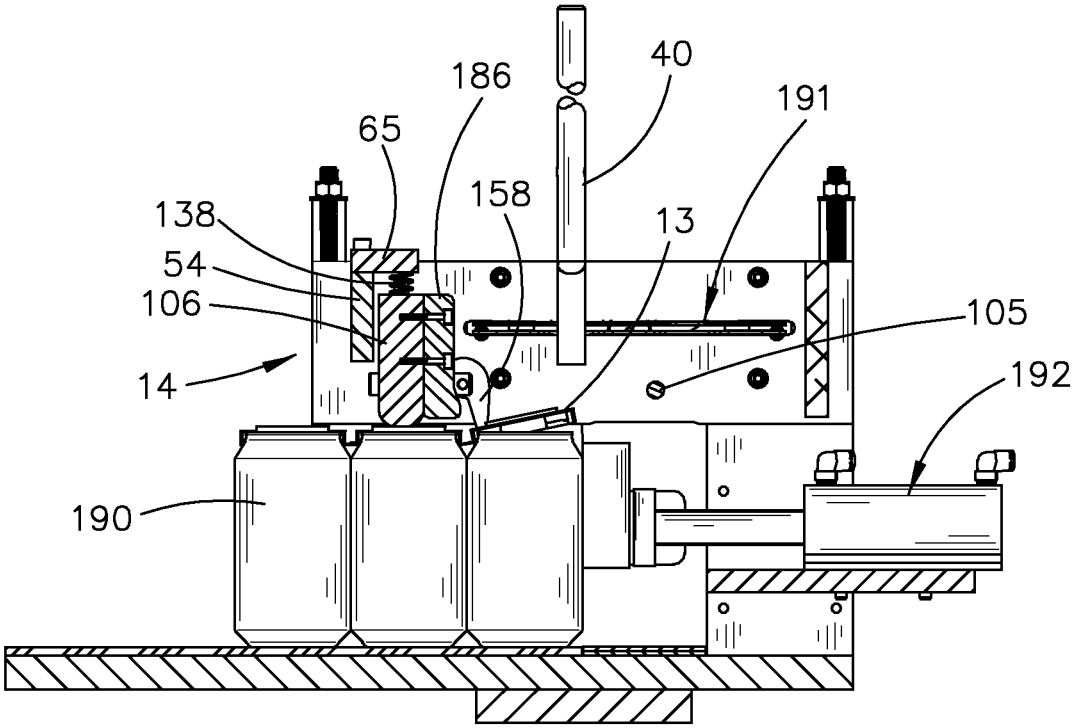
FIG. 13 is a partial sectional view illustrating the pawl of this invention engaging the can carrier of FIGS. 11 and 12 about to be further applied to trailing cans.

The numeral 190 refers to the cans upon which a can carrier 13 will be applied. The numeral 191 refers to a can carrier dispensing assembly upon which the can carriers 13 are stacked. The guide rods 40 and 92 position the can carriers 13 in a hopper-like fashion. The assembly 191 is designed to permit the lowermost can carrier 13 in the hopper to drop downwardly therefrom as illustrated in FIG. 11. As seen in FIG. 11, the can carrier 13, which is dispensed from the assembly 191, engages the bar 105 which causes the forward end of the can carrier 13 to drop downwardly. The pawl 158 limits the forward movement of can carrier 13 as seen in FIG. 11. As the cans 190 are sequentially pushed through the machine 12 by the can push assembly 192, the pawl 158 applies downward pressure on the can carrier 13 to maintain the can carrier 13 on top of the cans 190. As the can carrier 13 and the cans 190 pass beneath the lower end of spacer 108, the lower end of spacer 108 will move slightly upwardly against the force of the springs 138. As the cans 190 and can carrier 13 pass beneath the lower end of spacer 106, the spacer 106 exerts downward force on the can carrier 13 to seat the can carrier 13 onto the cans.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

an apparatus for applying a can carrier onto the upper ends of a plurality of cans as the cans pass through said apparatus;

said apparatus including a can passageway which is defined by horizontally spaced-apart vertically disposed first and second support walls with said can passageway having a forward end, a rearward end, a lower end and an upper end;

each of said first and second support walls having a forward end, a rearward end, an upper end, a lower end, an inner side and an outer side;

a can carrier hopper at said upper end of said can passageway;

said can carrier hopper being configured to support a plurality of can carriers, having forward and rearward ends, in a stacked position one on top of the other;

said carrier hopper being configured to position the lowermost can carrier in said carrier hopper above the cans onto which the can carrier is to be applied;

a vertically disposed standoff having a first end, a second end, an upper end, a lower end, a rear side and a front side;

said first end of said standoff being fixed to said first support wall at said upper end of said first support wall at said forward end of said first support wall;

said second end of said standoff being fixed to said second support wall at said upper end of said second support wall at said forward end of said second support wall;

a vertically disposed front spacer having a first end, a second end, an upper end, a lower end, a front side and a rear side;

said front spacer being positioned at said rear side of said standoff;

said front spacer having an opening formed therein which extends between said front and rear sides thereof;

said first end of said front spacer being vertically movably secured to said first support wall at said upper end of first support wall at said forward end of said first support wall;

said second end of said front spacer being vertically movably secured to said second support wall at said forward end of said second support wall;

said front spacer being movable between an upper position and a lower position with respect to said standoff and said first and second support walls;

said front spacer having a plurality of vertically disposed and horizontally spaced-apart spring openings formed therein which extend partially downwardly thereinto from said upper end thereof;

an elongated compression spring, having upper and lower ends, positioned in each of said spring openings;

said upper ends of said compression springs being positioned above said upper end of said front spacer;

a spring retainer mounted on said upper end of said standoff which is positioned over said upper ends of said compression springs to compress the same and to yieldably urge said front spacer to said lower position;

an elongated and horizontally disposed support tube, having a rear end and a front end;

said support tube being mounted in said opening in said front spacer whereby said rear end of said support tube is positioned rearwardly of said front spacer;

a vertically disposed pivotal pawl pivotally secured about a horizontal axis to said rear end of said support tube;

said pawl being pivotally movable between a first position and a second position;

an elongated coil spring having a rear end and a front end;

said front end of said coil spring being secured to said support tube;

said rear end of said coil spring being secured to said pawl;

said coil spring yieldably maintaining said pawl in said first position and yieldably resisting the pivotal movement of said pawl from said first position to said second position;

said pawl being in the path of a can carrier, which is to be mounted on cans moving through said apparatus, to prevent forward movement of the can carrier until sufficient forward force is applied to the cans upon which the can carrier is being applied; and said pawl remaining in pivotal contact with the can carrier being applied to the cans moving forwardly therebelow to urge the can carrier downwardly onto the cans due to said coil spring.

2. In combination:

an apparatus for applying a can carrier onto the upper ends of a plurality of cans as the cans pass through said apparatus;

said apparatus including a can passageway which is defined by horizontally spaced-apart vertically disposed first and second support walls with said can passageway having a forward end, a rearward end, a lower end and an upper end;

each of said first and second support walls having a forward end, a rearward end, an upper end, a lower end, an inner side and an outer side;

a vertically disposed standoff having a first end, a second end, an upper end, a lower end, a rear side and a front side;

said first end of said standoff being fixed to said first support wall at said upper end of said first support wall at said forward end of said first support wall;

said second end of said standoff being fixed to said second support wall at said upper end of said second support wall at said forward end of said second support wall;

a vertically disposed front spacer having an upper end, a lower end, a first end, a second end, a front side and a rear side;

said first end of said front spacer having vertically spaced first and second internally threaded bolt openings formed therein;

said first support wall having vertically spaced and vertically disposed upper and lower slots;

said second support wall having vertically spaced and vertically disposed upper and lower slots;

said second end of said front spacer having vertically spaced third and fourth internally threaded bolt openings formed therein;

a first bolt extending inwardly through said upper slot in said first support wall into said first internally threaded bolt opening in said front spacer;

a second bolt extending inwardly through said lower slot in said first support wall into said second internally threaded second bolt opening in said front spacer;

a third bolt extending inwardly through said upper slot in said second support wall into said third internally threaded bolt opening in said front spacer;

a fourth bolt extending inwardly into said lower slot in said second support wall into said fourth internally threaded bolt opening in said front spacer;

said front spacer being vertically movable between upper and lower positions with respect to said first and second support walls;

said front spacer having a plurality of spring openings formed in said upper end of said front spacer which extend partially downwardly into said front spacer;

an elongated spring, having upper and lower ends, extending downwardly into each of said spring openings whereby said upper ends of said springs are positioned above said upper ends of said front spacer;

a horizontally disposed spring retainer secured to said upper end of said third wall so as to extend over said upper ends of said springs so as to compress the same to yieldably urge said front spacer downwardly to its said lower position; and a can carrier engaging pivotal pawl secured to said rear side of said front spacer for engagement with the can carrier movably positioned therebelow.

3. The combination of claim 2 wherein said pawl is pivotally movable between first and second positions.

4. The combination of claim 3 wherein a spring is attached to said pawl to yieldably maintain said pawl in said first position and to yieldably resist the pivotal movement of said pawl from its said first position to its said second position.

5. In combination:

an apparatus for applying a can carrier onto the upper ends of a plurality of cans as the cans pass through said apparatus;

said apparatus including a can passageway which is defined by horizontally spaced-apart vertically disposed first and second support walls with said can passageway having a forward end, a rearward end, a lower end and an upper end;

each of said first and second support walls having a forward end, a rearward end, an upper end, a lower end, an inner side and an outer side;

a can carrier hopper at said upper end of said can passageway;

said can carrier hopper being configured to support a plurality of can carriers, having forward and rearward ends, in a stacked position one on top of the other;

said carrier hopper being configured to position the lowermost can carrier in said carrier hopper above the cans onto which the can carrier is to be applied;

a vertically disposed front spacer having a first end, a second end, an upper end, a lower end, a front side and a rear side;

said front spacer having an opening formed therein which extends between said front and rear sides thereof;

said first end of said front spacer being vertically movably secured to said first support wall at said upper end of first support wall at said forward end of said first support wall;

said second end of said front spacer being vertically movably secured to said second support wall at said forward end of said second support wall;

said front spacer being movable between an upper position and a lower position with respect to said first and second support walls;

a spring associated with said front spacer which yieldably urges said front spacer to said lower position;

an elongated and horizontally disposed support tube, having a rear end and a front end;

said support tube being mounted in said opening in said front spacer whereby said rear end of said support tube is positioned rearwardly of said front spacer;

a vertically disposed pivotal pawl pivotally secured about a horizontal axis to said rear end of said support tube;

said pawl being pivotally movable between a first position and a second position;

an elongated coil spring having a rear end and a front end;

said front end of said coil spring being secured to said support tube;

said rear end of said coil spring being secured to said pawl;

said coil spring yieldably maintaining said pawl in said first position and yieldably resisting the pivotal movement of said pawl from said first position to said second position;

said pawl being in the path of a can carrier which is to be mounted on cans moving through said apparatus to prevent forward movement of the can carrier until sufficient forward force is applied to the cans upon which the can carrier is being applied; and said pawl remaining in pivotal contact with the can carrier being applied to the cans moving forwardly therebelow to urge the can carrier downwardly onto the cans due to said coil spring.

6. In combination:

an apparatus for applying a can carrier onto the upper ends of a plurality of cans as the cans pass through said apparatus;

said apparatus including a can passageway which is defined by horizontally spaced-apart vertically disposed first and second support walls with said can passageway having a forward end, a rearward end, a lower end and an upper end;

each of said first and second support walls having a forward end, a rearward end, an upper end, a lower end, an inner side and an outer side;

a can carrier hopper at said upper end of said can passageway;

said can carrier hopper being configured to support a plurality of can carriers, having forward and rearward ends, in a stacked position one on top of the other;

said carrier hopper being configured to position the lowermost can carrier in said carrier hopper above the cans onto which the can carrier is to be applied;

a vertically disposed front spacer having a first end, a second end, an upper end, a lower end, a front side and a rear side;

said front spacer having an opening formed therein which extends between front and rearward ends thereof, an elongated and horizontally disposed support tube, having a rear end and a front end;

said support tube being mounted in said opening in said front spacer whereby said rear end of said support tube is positioned rearwardly of said front spacer;

a vertically disposed pivotal pawl pivotally secured about a horizontal axis to said rear end of said support tube;

said pawl being pivotally movable between a first position and a second position;

an elongated coil spring having a rear end and a front end;

said front end of said coil spring being secured to said support tube;

said rear end of said coil spring being secured to said pawl;

said coil spring yieldably maintaining said pawl in said first position and yieldably resisting the pivotal movement of said pawl from said first position to said second position;

said pawl being in the path of a can carrier which is to be mounted on cans moving through said apparatus to prevent forward movement of the can carrier until sufficient forward force is applied to the cans upon which the can carrier is being applied; and said pawl remaining in pivotal contact with the can carrier being applied to the cans moving forwardly therebelow to urge the can carrier downwardly onto the cans due to said coil spring.

* * * * *